US005442881A

United States Patent [19]

Asbach et al.

[11] Patent Number: 5,442,881

[45] Date of Patent: Aug. 22, 1995

[54] PRESSURE-FIT GATE ASSEMBLY

[75] Inventors: Ronald M. Asbach, Grand Island; Robert C. Barrett, Angola, both of N.Y.

[73] Assignee: Fisher-Price, Inc., East Aurora, N.Y.

[21] Appl. No.: 243,131

[22] Filed: May 16, 1994

[51] Int. Cl.[6] ..... E05C 21/02

[52] U.S. Cl. ..... 49/465; 49/13; 49/55; 49/449

[58] Field of Search ..... 49/465, 463, 55, 57, 49/449, 450, 13; 160/225, 224

[56] References Cited

U.S. PATENT DOCUMENTS

| | | | |
|---|---|---|---|
| D. 300,949 | 5/1989 | Johnson, Jr. | D25/50 |
| D. 301,622 | 6/1989 | Kujawski | D25/50 |
| 2,928,146 | 3/1960 | Kuniholm | 20/71 |
| 2,982,353 | 5/1961 | Luger | 160/183 |
| 3,035,862 | 5/1962 | Phelps | 292/302 |
| 3,163,205 | 12/1964 | Gottlieb | 160/216 |
| 3,431,966 | 3/1969 | Injeski | 160/225 |
| 3,680,260 | 8/1972 | Bauer | 49/465 |
| 4,570,985 | 2/1986 | Waldo et al. | 292/262 |
| 4,583,715 | 4/1986 | Wright | 49/55 X |
| 4,607,455 | 8/1986 | Bluem et al. | 49/57 X |
| 4,611,431 | 9/1986 | Lauro | 49/55 |
| 4,677,791 | 7/1987 | Larson et al. | 49/463 |
| 4,685,247 | 8/1987 | Alam | 49/55 |
| 4,702,036 | 10/1987 | Johnson | 49/55 |
| 4,777,765 | 10/1988 | Johnson, Jr. | 49/55 |
| 4,787,174 | 11/1988 | Brown | 49/55 |
| 4,831,777 | 5/1989 | Johnson, Jr. | 49/55 |
| 4,884,614 | 12/1989 | Spurling | 160/225 |
| 4,944,117 | 7/1990 | Gebhard et al. | 49/55 |
| 5,052,461 | 10/1991 | Stern | 160/224 |
| 5,111,615 | 5/1992 | Kuhnt et al. | 49/13 X |
| 5,117,585 | 6/1992 | Andrisin, III | 49/57 X |
| 5,154,455 | 10/1992 | Awalt, Jr. | 292/42 |
| 5,272,840 | 12/1993 | Knoedler et al. | 49/463 |

FOREIGN PATENT DOCUMENTS

| | | | |
|---|---|---|---|
| 2058186 | 4/1981 | United Kingdom | 49/55 |
| 2193992 | 2/1988 | United Kingdom | E06B 11/02 |
| 2214551 | 9/1989 | United Kingdom | E06B 11/06 |

*Primary Examiner*—Philip C. Kannan

*Attorney, Agent, or Firm*—Howrey & Simon; C. Scott Talbot; Leo J. Jennings

[57] ABSTRACT

A safety gate that has a continuously adjustable width for insertion across a lateral opening such as a doorway. The gate has a generally U-shaped gate frame including two tubular frame members that are slidably connected in a telescoping relationship. A latch is operable to displace the telescoping portions by a pre-selected displacement relative to each other, so that part of the tubes are deflected and the gate frame applies an outward lateral force to the doorway opening sides to retain the gate across the opening. The gate includes a walk-through door with a door latch for latching the door closed and an indicator for indicating when it is not fully closed and latched. A force-distribution bar on at least one side of the gate distributes the force from that side of the gate so that it is applied at two points on that side of the doorway opening.

28 Claims, 15 Drawing Sheets

PRESSURE-FIT GATE ASSEMBLY

BACKGROUND OF THE INVENTION

The invention relates generally to a safety gate that is removably insertable into an opening such as a doorway. Such gates are used, for example, to prevent a child or a pet from passing through the doorway. More specifically, the invention relates to an adjustable-width, pressure-fit gate that is frictionally retained in the doorway opening by application of outward lateral force to the sides of the opening.

One type of conventional safety gate requires hardware to be mounted to the door frame sides to provide mounting points for the gate. For example, U.S. Pat. No. 4,884,614 to Spurling discloses a safety gate including a mounting rail attached to one doorway opening side and a locking post attached to the opposite doorway opening side. A hinged swinging door is mounted by inserting the hinged side of the door into the mounting rail. The door may be secured shut by locking the other side to the locking post.

The mounting hardware requirement imposes several disadvantages on this type of gate. Although it is often desirable to have a gate that is usable in many different openings, this conventional gate may only be used in openings where the hardware has already been installed. In addition, the hardware adds cost, is inconvenient to install, and is unsightly.

To overcome the foregoing problems of hardware-mounted gates, pressure-fit gates are known. These gates are frictionally retained in the doorway opening by application of an outward lateral force to the opening. For example, Great Britain Patent No. 2 193 992 to Alam discloses a generally U-shaped safety gate with a door. Four contact pads for securing the gate are each independently adjustable and apply outward pressure to frictionally retain the gate in the doorway.

This type of pressure-fit gate requires time consuming adjustment of each contact pad every time the gate is installed. This gate has a limited adjustment range and the adjustment also makes if difficult for the user to determine the amount of force being applied by each contact pad. Further, this gate is not seen to provide for convenient application of a repeatable and predictable outward force to retain the gate.

Another type of pressure-fit gate, described in U.S. Pat. No. 4,607,455 to Bluem et al., includes first and second gate sections that are adjustable relative to each other to adjust the overall width of the gate. One section includes a lever for rotating a gear wheel having teeth for engaging a rack of gear teeth on the other section to spread apart the sections. The lever has a non-engaging position so that the sections may be freely moved relative to each other to provide coarse adjustment of the gate width. Once the width has been adjusted to an overall width slightly less than the doorway opening, the gears are engaged and the lever is rotated to spread apart the sections. The sections are thus pressure-fit into the doorway opening This type of pressure-fit gate suffers from several disadvantages. Since the outward pressure force is distributed throughout the gate panels, it is difficult to provide an opening or walk-through portion in the gate. The distribution of force throughout the gate panels also may result in undesirable warping of the gate panels under the load. In addition, it is difficult to adjust the relationship between the pressure applied to the doorway opening sides near the top of the gate and the pressure applied to the doorway opening sides near the bottom of the gate. Applying a greater pressure force near the top of the gate may be desirable where it is anticipated that the greatest side loads on the gate are likely to be applied near the top, for example by a child leaning against the top of the gate.

This type of gate also does not compensate for an out-of-square doorway opening, such as in the situation where the distances between the sides of the opening are different at the top and bottom contact portions of the gate. These variations in the doorway width can occur where the doorway sides are out of plumb or be caused by the presence of baseboard moulding near the floor. In a gate such as the one described in the Bluem et al. patent, the relationship between the top and bottom pressures is affected by differences between the top and bottom widths of the opening—a relatively greater pressure will be applied at the location where the doorway is narrower.

Also, since the starting point for the geared system is necessarily always relative to a gear tooth, each of the possible actual starting positions for expansion of the gate are spaced apart by a distance corresponding to the gear pitch. Thus, this system provides only an incrementally variable—not continuously variable—range of starting points. However, since the range of possible doorway opening widths is continuously variable, the gate starting point may vary relative to the doorway width for different doorways. When the gate starting point varies relative to the doorway opening as in the Bluem, et al. gate, the displacement of the panels, and hence the final force applied to the opening, after rotating the lever by a specific amount, will also vary. Consequently, this type of gate does not conveniently apply a repeatable and predictable force across a varying range of door openings.

Another type of pressure-fit gate is disclosed in U.S. Pat. No. 4,944,117 to Gebhard et al., in which two gate panels are slidably connected for width adjustment and are then secured together by a thumbscrew. Depressing a foot pedal on one panel moves a mechanical system to extend a pair of contact pads outward from one panel against the doorway opening side to frictionally retain the gate. A ratchet in the mechanical system locks the contacts pads in the outward position.

This gate also suffers from the disadvantages associated with the outward pressure force being distributed throughout the gate panels. Further, this mechanical system also fails to conveniently apply a repeatable and predictable outward lateral force to the pads.

Yet another type of pressure-fit gate is disclosed in U.S. Pat. No. 5,052,461 to Stern. This gate includes two panels that are extendable relative to each other to provide doorway width adjustment. After adjustment, the panels are secured together. Spring-biased upper and lower plungers mounted to one panel apply pressure contact to one side of the door opening to frictionally retain the gate. A handle is manually operable to retract the plungers for removal of the gate.

This type of gate also suffers from several disadvantages. The spring members and plungers occupy a large area in the door panel, making a walk-through gate difficult to achieve.

Still other types of pressure-fit gates are known in which levers are operated to extend the width of the gate so that it applies outward lateral pressure on the doorway opening. For example, U.S. Pat. No. 3,163,205 to Gottlieb discloses a gate supported by upper and lower telescoping rods, each having a lever mechanism provided at the telescoping connection. Once the gate is approximately fit into the opening, the levers on each rod are operated to engage and elongate each rod to apply the outward pressure. The levers each move a toothed catch that engaged a rack section on the telescoping rod to enter the rod. In another example, U.S. Pat. No. 2,928,146 to Kunihelm discloses a door gate having a lever arm that is pivoted to urge an upper bumper outward to pressure-fit the gate. A linkage connected to the lever arm also urges a lower bumper outwards when the lever is pivoted.

These gates also are not well suited to the provision of a walkthrough opening, since they include a top member spanning across the width of the gate.

SUMMARY OF THE INVENTION

The drawbacks of the prior art are overcome by the present invention which provides a pressure-fit gate assembly that is continuously adjustable to fit a continuously variable range of doorway openings, and that once adjusted, conveniently provides a repeatable and predictable outward force to retain the gate in the opening, even with doorway openings of non-constant width.

Further, a latch assembly is provided capable of achieving a high magnitude outward force sufficient to resist high lateral loads with a low magnitude user input force. The latch displaces one gate frame member relative to another gate frame member by a pre-selected distance to generate the outward force.

Also, a force-distribution member is provided capable of dividing and distributing an outward force received at a single point for application at two locations so that a greater force may be applied at one location than at the other location for higher sideways load resistance at that location.

The present invention also provides a walk-through opening that is closable by a door, a door latch for positively latching the door closed, and an indicator for indicating whether the door is positively closed and latched.

DETAILED DESCRIPTION

The invention is illustrated below in the context of a safety gate for blocking a doorway opening. However, the gate described below may be inserted and frictionally retained in any opening flamed by two opposing sides. In addition, the latch mechanism for generating outward lateral force in the gate described below may be suitable for other applications where it is desired to displace one member relative to another by a pre-selected distance. Also, the door latch and the door latch indicator described below may be suitable for other applications where it is desirable to latch a door and/or provide an indication of the positive latching of a door.

Figure 1:
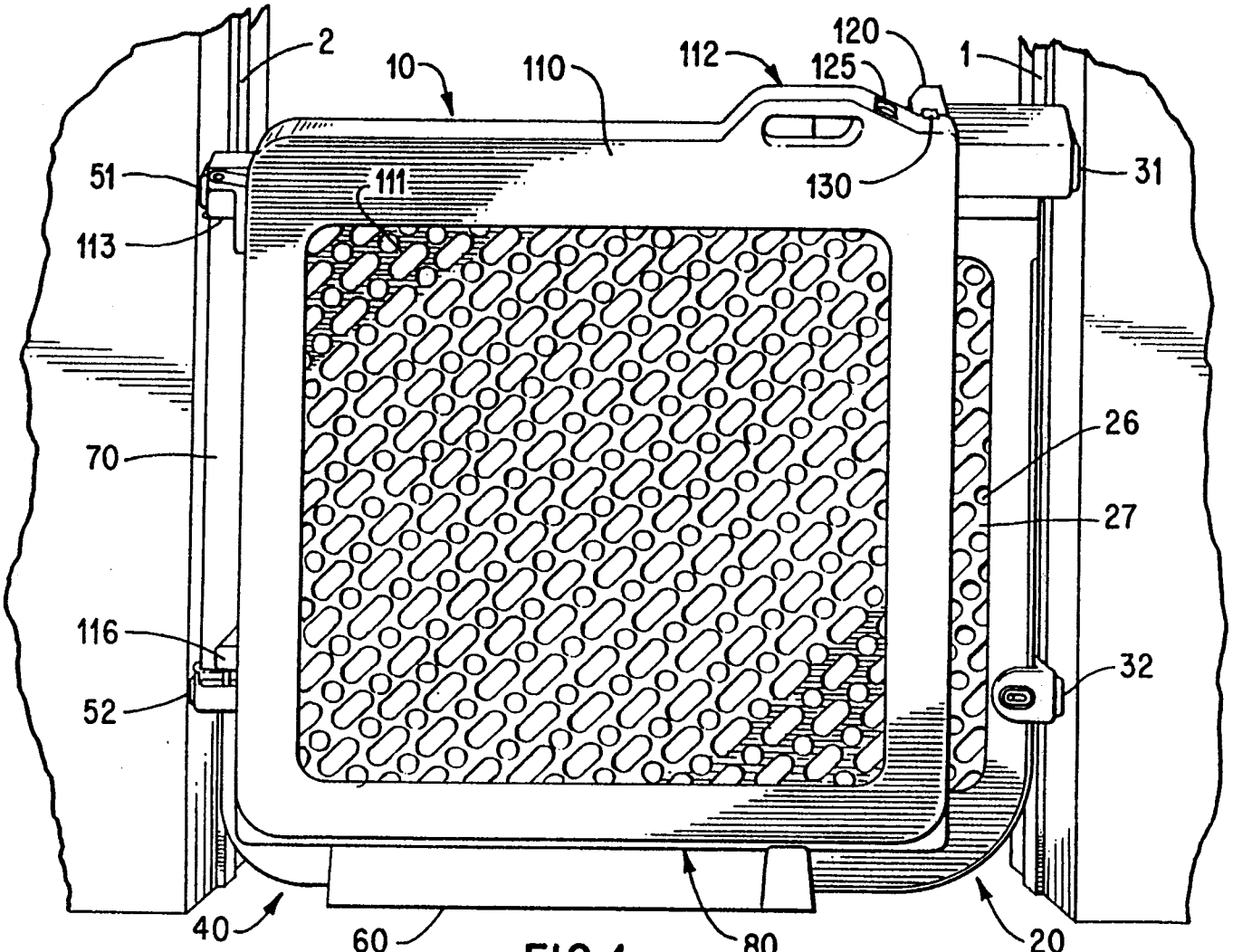
FIG. 1 is a front perspective view of the gate assembly installed in a door frame.
Figure 2:
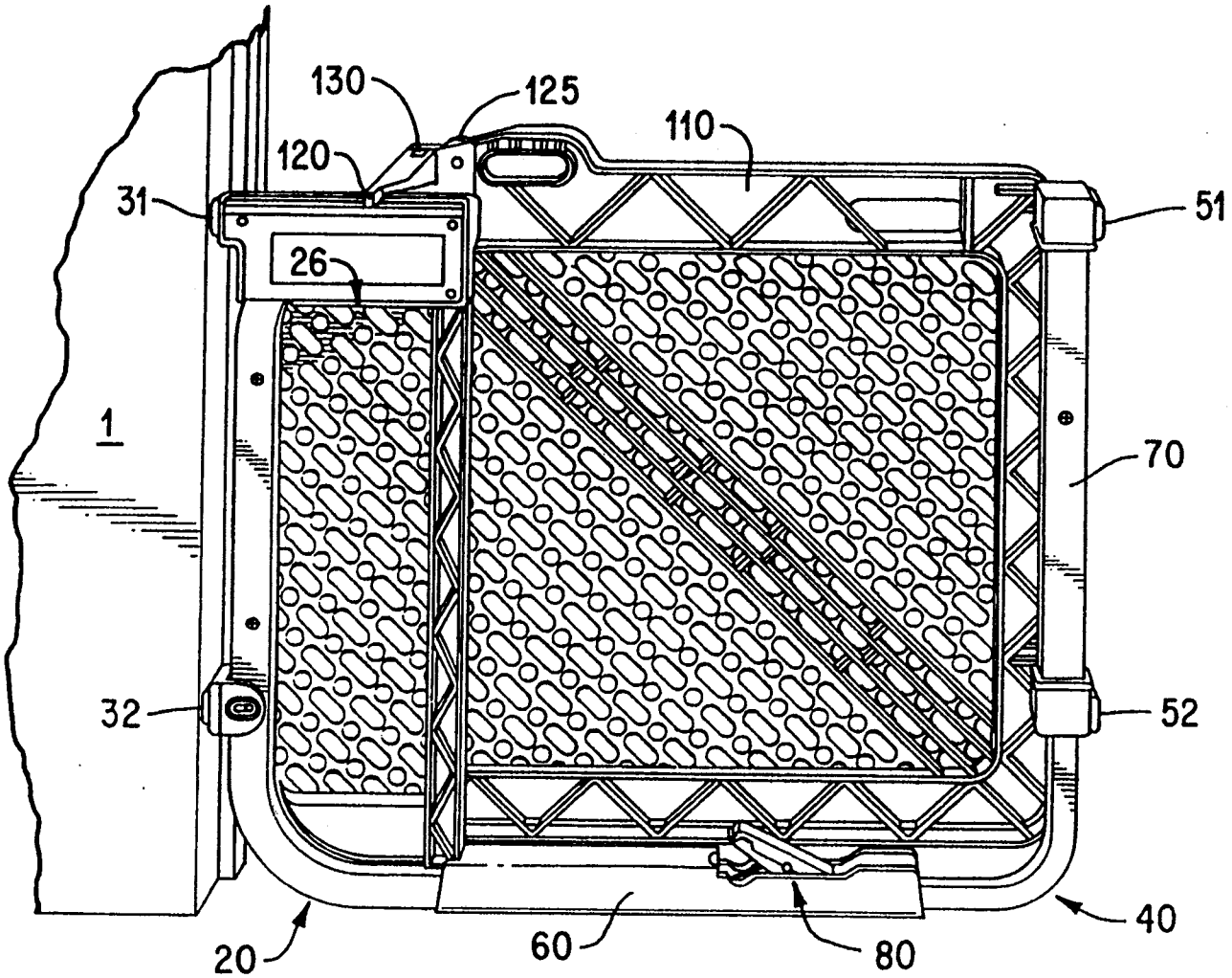
FIG. 2 is a rear perspective view of the gate assembly.
Figure 3:
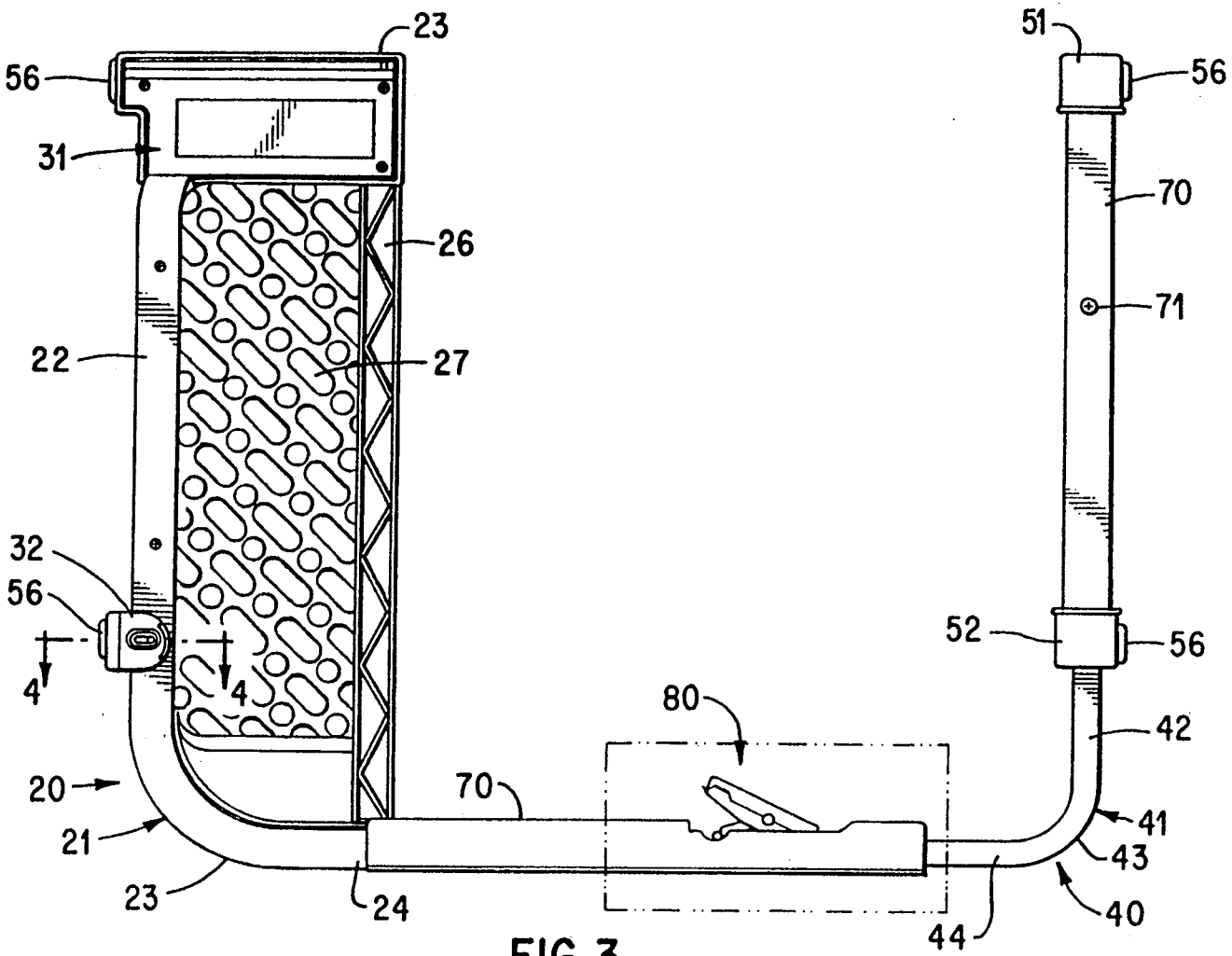
FIG. 3 is a partial rear view of the gate frame.

FIG. 1 illustrates the gate assembly 10 pressure-fit into a doorway opening having two sides 1 and 2. As also seen in FIGS. 2 and 3, the gate assembly 10 includes a first gate frame member 20 capable of pressure contact with one side of the doorway opening 1 via upper bumper 31 and lower bumper 32, and a second gate frame member 40 capable of pressure contact with the other side of the door opening 2 via upper bumper 51 and lower bumper 52. A panel 26 and a hinged door 110 span between the first and second gate frame members 20 and 40 to block the doorway opening.

The first gate frame member 20 includes a generally L-shaped bent first tube 21 having a substantially vertical first side portion 22, a curved first intermediate portion 23, and a first lateral connecting portion 24. The first intermediate portion 23 and first lateral connecting portion 24 together form a first upright portion. The second gate frame member 40 has an opposing generally L-shaped bent second tube 41 having a substantially vertical second side portion 42, a curved second intermediate portion 43, and a second lateral connecting portion 44. The second intermediate portion 43 and second lateral connecting portion 44 together form a second upright portion.

The second lateral connecting portion 44 telescopes into the larger diameter first lateral connecting portion 24 so that the two L-shaped tubes 21 and 41 together have a U-shaped orientation. The telescoping connection permits sliding relative displacement of the first and second frame members 20 and 40 relative to each other so that they may be spread apart or drawn together to adjust the overall width of the gate. A threshold 60 partially surrounds the telescoping connection of the lateral first and second connecting portions 24 and 44.

A latch 80 is mounted to the first connecting portion 24 and is engageable with the second connecting portion 44. The latch 80 is selectively releasable to a non-engaging position to permit displacement of the connecting portions 24 and 44 relative to each other along the lateral direction for continuously variable width adjustment of the gate to fit inside the doorway opening. The latch 80 is also operable to an engaging position to engage the second connecting portion 44 and to displace the second connecting portion 44 relative to the first connecting portion 24 by a pre-selected displacement in the lateral direction, thereby urging the first and second curved intermediate portions 23 and 43 apart.

Figure 4:
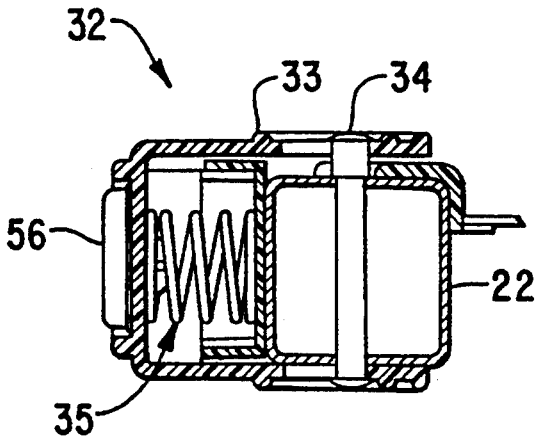
FIG. 4 is a sectional view of a side bumper, taken along the line 4—4 shown in FIG. 3.

An upper bumper 31 and a lower bumper 32 each having a urethane pad 56 for frictionally contacting the doorway opening side 2 are mounted to the first gate frame member 20. The lower bumper 32, as shown in detail in FIG. 4, includes a housing 33 having slots for receiving a rivet 34 to attach the bumper to the first side portion 22 of the first gate frame member 20. The lower bumper 32 is thus capable of some horizontal travel and is biased outward by a pair of springs 35 to compensate for a variation in width of the upper and lower parts of the doorway opening, such as an out-of-square condition of the doorway opening.

Figure 5:
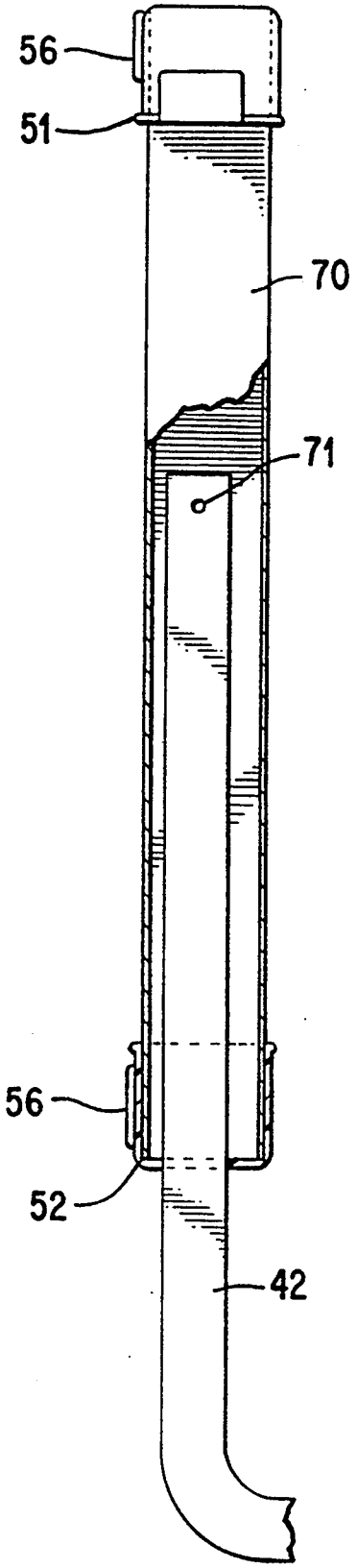
FIG. 5 is a partial front view of a force-distribution member.

As shown in more detail in FIG. 5, an elongated force-distribution bar 70 is mounted by a pivot 71 to the second side portion 42. An upper bumper 51 and a lower bumper 52 each having a urethane pad 56 for frictionally contacting the doorway opening side 1 are mounted to the force-distribution bar 70. The bar 70 is free to rotate about the pivot 71 to compensate for an out-of-square or variable-width doorway opening. The bar 70 is a tube having a rectangular cross-section, and is mounted concentrically over the second side portion 42. The internal width in the direction perpendicular to the pivot 71 is larger than the outer cross-section of the second side portion 42. The additional internal width of the bar 70 allows the bar 70 to have a range of rotation about the pivot 71. Since the range of rotation is limited by contact of the inner surface of the lower part of bar 70 against the outside surface of side portion 42, increasing the inner width of the bar 70 will give a larger range of rotation. Of course, the bar need not have the cross-section described, and could have a different shape that connects two contact points to the pivot 71. The bar 70 also distributes the outward force from the vertical second side portion 42 to the upper and lower bumpers 51 and 52 in a pre-selected proportion, so that, for example, greater force may be applied to the upper bumper 51 than to the lower bumper 52.

Returning to FIGS. 1 through 3, when the gate has been adjusted to fit into the doorway opening, and the side portions are approximately in contact with the doorway opening sides 1 and 2 via the bumpers 31, 32, 51 and 52, the lateral displacement causes bending of the first and second curved intermediate portions 23 and 43 and the first and second side portions 22 and 42, which creates a lateral force applied by the first and second side portions 22 and 42 against the doorway opening sides 1 and 2 via the bumpers 31, 32, 51 and 52. The latch 80 also locks the displaced tubes, thus maintaining the force applied against the doorway opening sides 1 and 2.

Figure 6:
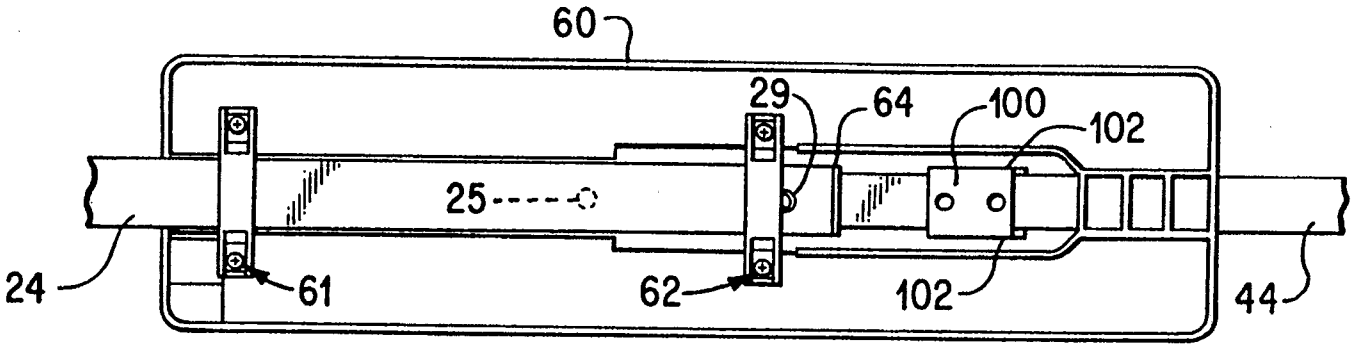
FIG. 6 is a partial bottom view of the gate frame.
Figure 7:
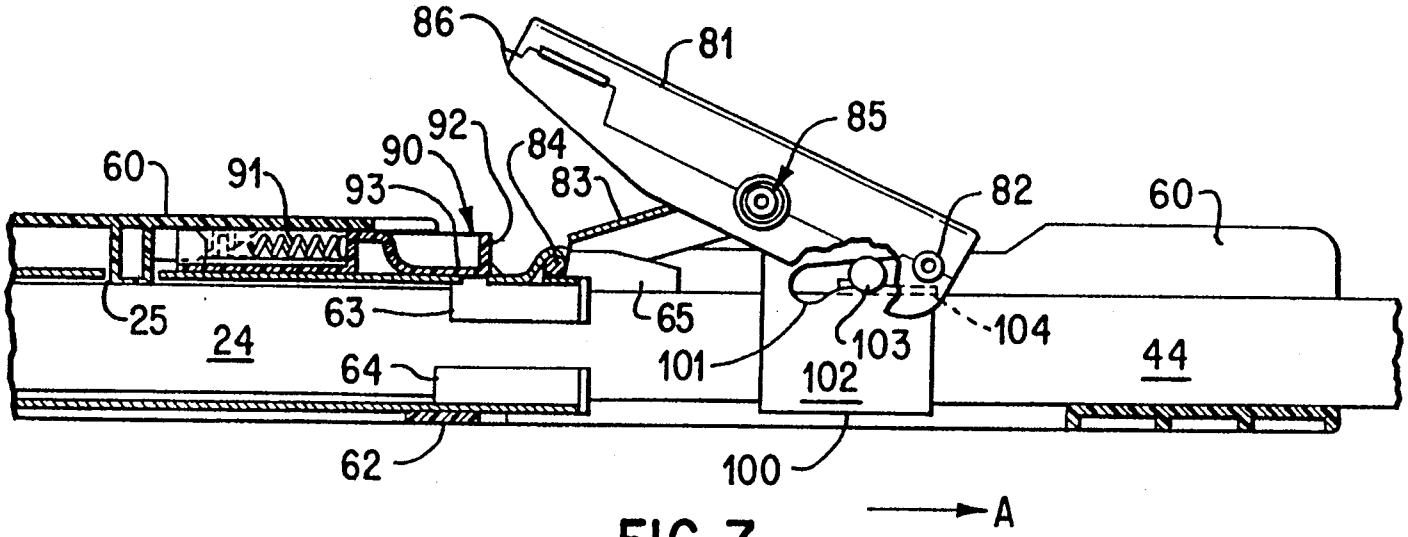
FIG. 7 is a partially sectional rear view of the latch mechanism.
Figure 8:
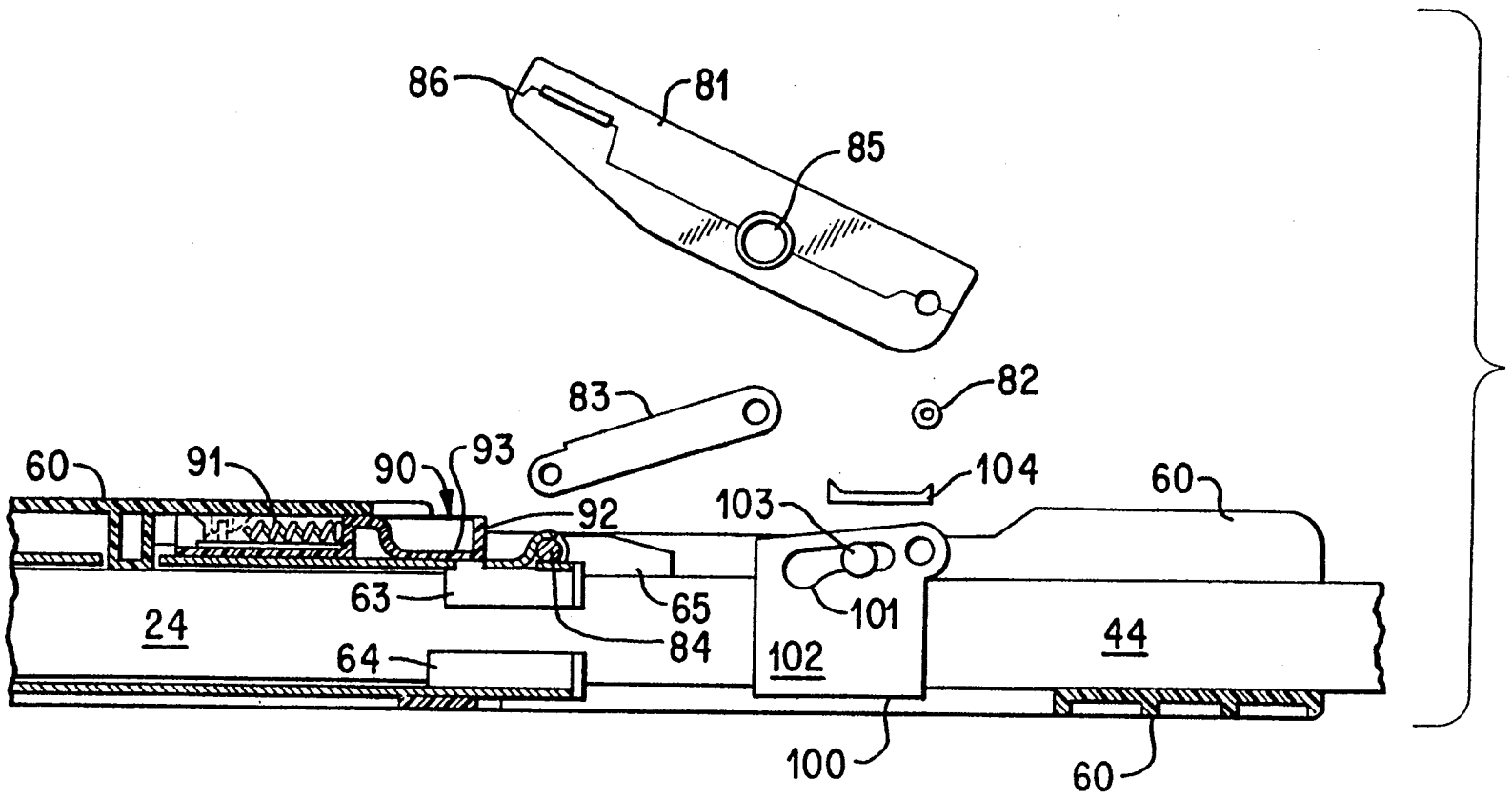
FIG. 8 is an exploded rear view of the latch mechanism.

The latch 80 and the connecting portions 24 and 44 are illustrated in more detail in FIGS. 6 through 8. The first connecting portion 24 of the first gate frame member 20 is attached to the threshold 60 by a detent 25 in the first gate frame member 20 and by a pair of straps 61 and 62. The second connecting portion 44 of the second gate frame member 40 slides through an upper bushing 63 and a lower bushing 64, both mounted to the open end of first connecting portion 24, to telescope within the first connecting portion 24.

A bracket 100 partially surrounds and is slidable along the second connecting portion 44. The bracket 100 is generally U-shaped and has an angled slot 101 through each side 102 as shown. A rod 103 extends between the slots 101 and over the upper surface of the second connecting portion 44. Due to the ramp angle of the slots 101, when the bracket 100 is urged along the second connecting portion 44 in a direction away from the first connecting portion 24 (shown by arrow A), the rod 103 rolls down the slots 101 and becomes wedged between the upper edge of the slots 101 and the second connecting portion 44 to apply a clamping force to the second connecting portion 44 to frictionally interengage the bracket 100 with the second connecting portion 44.

The amount of clamping force achieved is dependent on the ramp angle (7° in the illustrated embodiment), the rod diameter (0.250" (0.64 c.m.) in the illustrated embodiment) and the coefficient of friction between the surfaces. All three of these variables can be adjusted to suit the design requirements (for example, the rod can be knurled to give it more bite on the connecting portion and bracket). In the preferred embodiment, gravity acts on the pin and bracket to ensure that the rolling and clamping will occur. If other spatial orientations were desired, the rod could be biased by other means (such as a spring). The components essential to the clamping function of the latch are the bracket (with the angled slots), the rod, and a connecting portion to be engaged and displaced. Although the connecting portion is a tube in the preferred embodiment, the tube may be replaced by any number of materials and profiles, for example a metal or cloth strap.

Although not necessary for operation of the latch mechanism, a plate 104 as shown in FIGS. 6 through 8 is provided between the rod 103 and the second connecting portion 44 to distribute the clamping force over a larger area to protect the finish of the connecting portion 44. The plate 104 generally slides along the second connecting portion 44 under the rod 103 and provides frictional contact between the rod 103 and the second connecting portion 44 when the rod is wedged.

The latch 80 includes a lock lever 81 attached to the bracket 100 by a rivet 82. A link 83 is attached by a rivet 84 at one end to the first connecting portion 24 and attached by a rivet 85 at the other end to the lock lever 81. A catch member having a cam surface 92 at one end slides laterally in the threshold and is biased by a spring 91 so that when the lock lever 81 is depressed, an angled tab 86 on the end of the lock lever 81 contacts the cam 92 and moves catch 90 inwardly against the spring bias. When the tab 86 clears the cam surface 92, the catch 90 returns so that the lock lever 81 is locked in the fully depressed position. The catch 90 also has a thumb depression 93 to facilitate sliding the catch 90 to free the lock lever 81 so that the lock lever 81 may be lifted to release the latch 80.

Figure 9A:
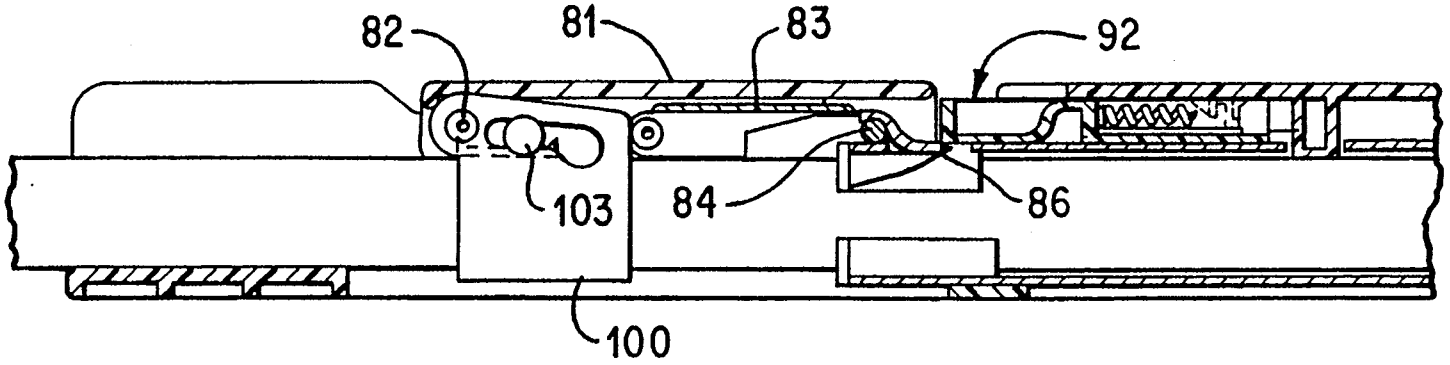
FIGS. 9A and 9B are schematic front views showing two operational positions of the latch mechanism.
Figure 9B:
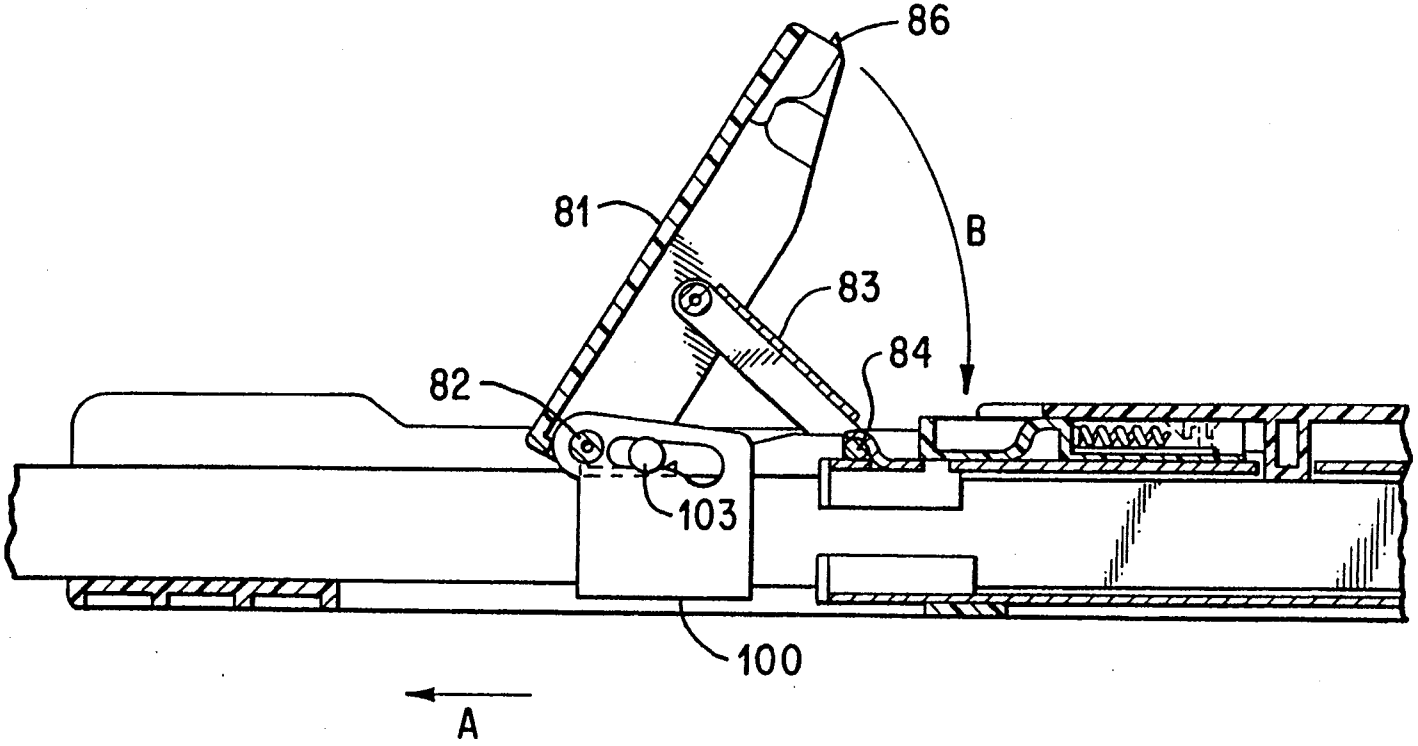

FIGS. 9A and 9B illustrate the latch mechanism in two operational positions. To release the latch 80 from the locked position shown in FIG. 9A, the catch 90 is slid away from the lock lever 81 to free the lock lever 81, and the lock lever 81 is then fully raised to the position shown in FIG. 9B. In this position the rod 103 is held near the top of the slots 101 by a stop 65 on the upper bushing 63. Since the rod 103 is thus held, it cannot wedge against the second connecting portion 44 and the second connecting portion 44 is free to telescope into and out from the first connecting portion 24 for adjustment of the gate width.

The lock lever 81 and link 83 are used to gain leverage and apply a pre-selected displacement to the connecting portions 24 and 44. The lever and link arrangement in the preferred embodiment provides both an adequate clamping force and an adequate outward lateral force from application of a relatively low user input force. The lock lever 81 is positioned so that a user depresses the lock lever 81 to rotate it in the direction shown by arrow B in FIG. 9B. Depressing the lever causes the bracket 100 to move in the direction shown by arrow A, and causes the rod 103 to slide down the slot 101 and wedge against the plate 104 so that the rod 103, bracket 100 and plate 104 frictionally engage the second connecting portion 44 and displace it in the outward telescoping direction relative to the first connecting portion 24. The latch 80 in FIG. 9A is shown in a toggled locked position where the rivet 85 on the link 83 has gone over-center past the rivet 84 and the rivet 82. With this locking action, the catch 90 is not necessary to maintain a clamped and locked latch 80, but functions as a redundant method to ensure that a child could not release lock lever 81.

The fully displaced position is shown in FIG. 9A. The relative displacement of the connecting portions is repeatable and predictable because of the latch lever and link geometry. In a preferred embodiment, the displacement is 1.63" (4.13 c.m.). If the gate is adjusted so that the bumpers 31, 32, 51 and 52 are just touching the sides 1 and 2 of the doorway opening before the latch 80 is depressed, the latch displacement will result in repeatable and predictable forces being applied at the doorway opening sides.

The magnitude of the outward forces will depend on the amount of displacement of the connecting portions 24 and 44, the geometry of the intermediate portions 23 and 43 and the side portions 22 and 42, as well as the materials used. In the preferred embodiment, the first connecting portion 24, first intermediate portion 23 and first side portion 22 are all formed by a single bent steel tube 21 having a 1" (2.54 c.m.) square cross section. The first intermediate portion 23 is a curved bend in the tube that curves around a radius of 2.5" (6.4 c.m.) (to the center line) and an angle of 91.5°. The second connecting portion 44, second intermediate portion 43 and second side portion 42 are all formed by a single bent steel tube having a 1.25" (3.2 c.m.) square eross-section. The second intermediate portion 43 is a curved bend in the tube that curves about a radius of 4.4" (11.1 c.m.) (to the center line) and an angle of 91.2°. The pivot 71 is located 19.0" (48.3 c.m.) above the center line at the second connecting portion 44. The preferred embodiment as described will create a outward force of at least 30 pounds at the upper bumpers and 20 pounds at the lower bumpers. Of course, the above dimensions and forces are given by way of example only.

Figure 13:
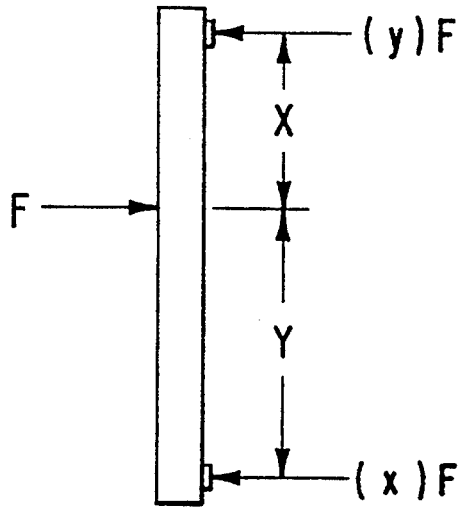
FIG. 13 is a diagram showing the forces acting on the force distribution member.

FIG. 13 shows the forces acting on the force-distribution bar 70. The force-distribution bar 70 allows the gate to self-adjust to the doorway opening in the event that the sides of the doorway opening 1 and 2 are not square and perpendicular to the floor. The force that is applied to the pivot point 71 is divided and distributed to two points (bumpers 51 and 52) located at opposite ends of the force-distribution bar 70. By providing this self adjustability, the force-distribution bar avoids the situation in an out-of-square or varying-width doorway opening where one of the two pads on one side of a conventional gate may have little or no contact pressure, which greatly reduces the ability to resist sideways loads.

Depending upon the distances x and y to each point where the contact pads 56 of the bumpers 51 and 52 are located from the pivot point 71, predetermined proportional forces can be applied via each bumper. For example, in the preferred embodiment, greater outward force is applied by the upper bumper 51 to provide a greater frictional retaining force near the top of the gate, since it is expected that the greatest side loads on the gate are likely to be applied near the top. In the preferred embodiment the distance x is approximately 9.6" (24.4 c.m.) and the distance y is approximately 11.6" (29.5 c.m.). Accordingly, the force applied at the upper bumper 51 is approximately 1.21 times that applied at the lower bumper 52. Of course, these dimensions are given by way of example only, and may be varied to produce any desired force-distribution.

Turning back to FIGS. 1 through 3, the first gate frame member 20 includes a panel 26 extending inwardly from the first side member 22 to partially block the doorway opening. The panel 26 may include a plastic grille 27 as shown. A door 110, also shown in FIGS. 10 and 11A, includes a plastic grille 111 and has a handle 112 at the top near its free end. The door 110 is mounted by upper and lower hinges 113 and 116 to the force-distribution bar 70. The lower hinge 116 includes a bracket 118 mounted to the force-distribution bar 70. The bracket 118 is slotted to permit horizontal movement of the lower hinge pin 117 in addition to conventional rotation of the door about the hinge axis. The upper hinge 113 includes a tapered pin 115 and bracket 114 so that the free end of the door 110 has some vertical travel when lifted by the handle 112. The combination of hinges 113 and 116 allows rotation of the door 110 of the upper hinge 113 about an axis perpendicular to the plane of the gate 110 so that the handle end of the door 110 can be raised and lowered.

Lifting the door 110 by the handle 112, closing and then lowering the door 110 allows a downwardly-projecting hook 120 on the door to extend over a top rail 28 located along the top of the panel 26 on the first gate frame member 20. The engagement of the hook 120 over the top rail 28 holds the door 110 closed.

Figure 10:
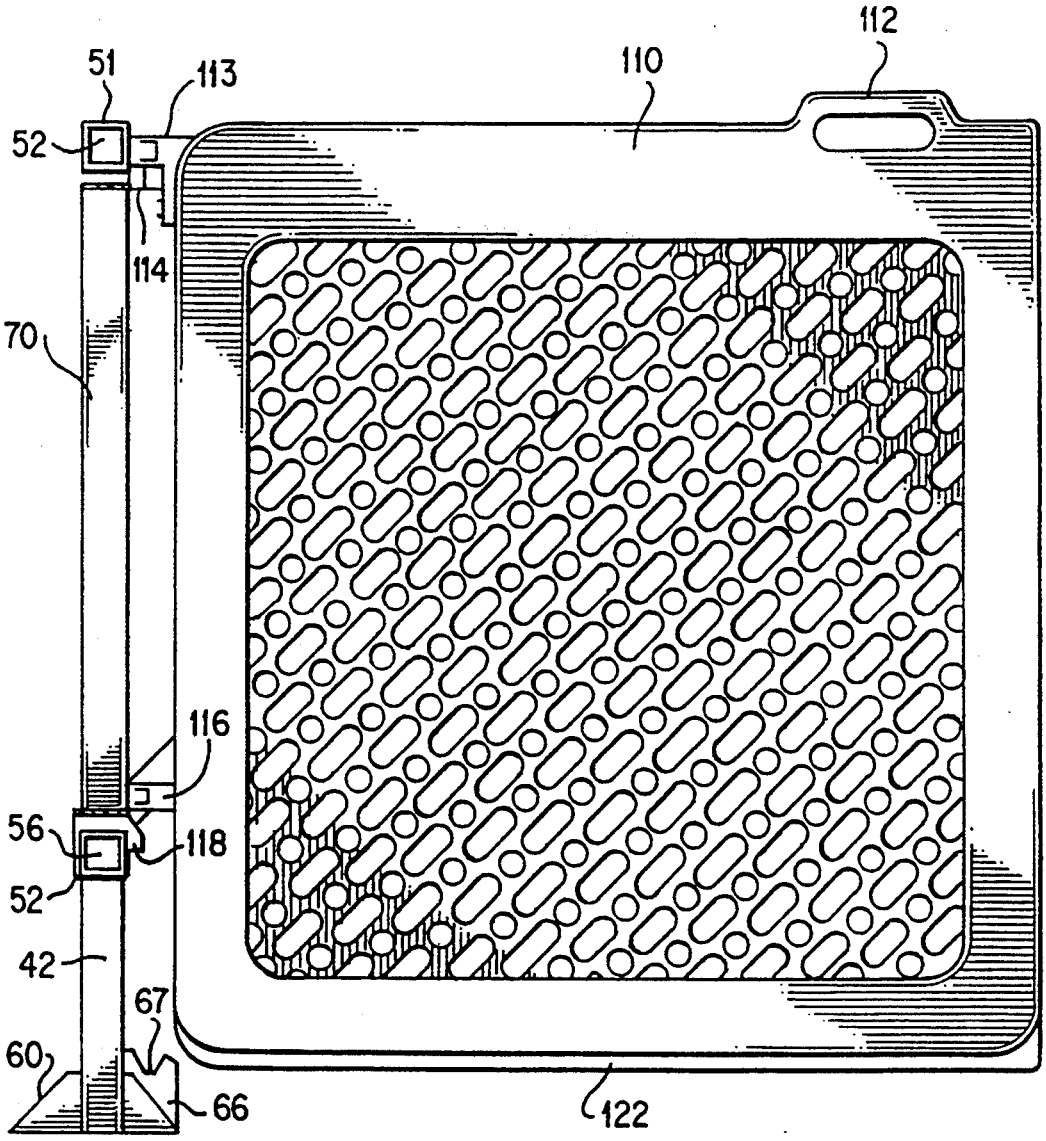
FIG. 10 is an end view of the gate apparatus, showing the door panel in an open position.
Figure 11A:
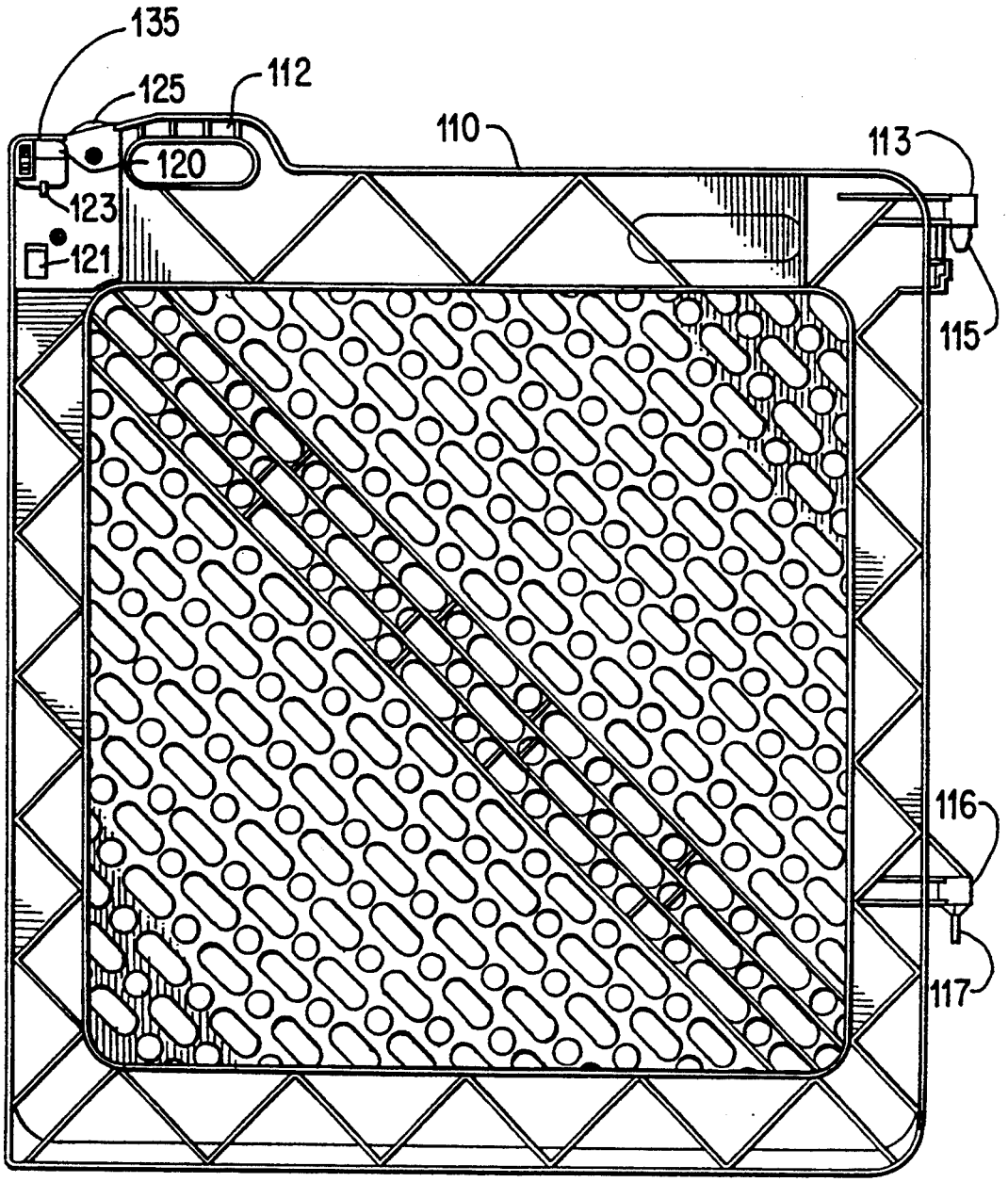
FIG. 11A is a rear view of the door panel.

As shown in FIGS. 11A, 1 lB, 12A and 12B, a spring-biased protruding tab 121 is provided on the door 110 to interlock with a shoulder 29 on the top rail 28 to positively lock the door 110 closed by preventing it from being lifted. In addition, as shown in FIG. 10 the threshold 60 includes a raised door stop 66 having a groove 67 into which a flange 122 on the door bottom fits to also hold the door 110 closed. The tab 121 is retractable by pressing a button 125 that is connected by an internal linkage (not shown) to the tab 121. Depressing the button 125 unlocks the door 110 by retracting the tab 121 so that the door 110 may be lifted until the hook 120 clears the top rail 23. At this point the flange 122 clears the door stop 66, and the door 110 is free to swing open.

Figure 11B:
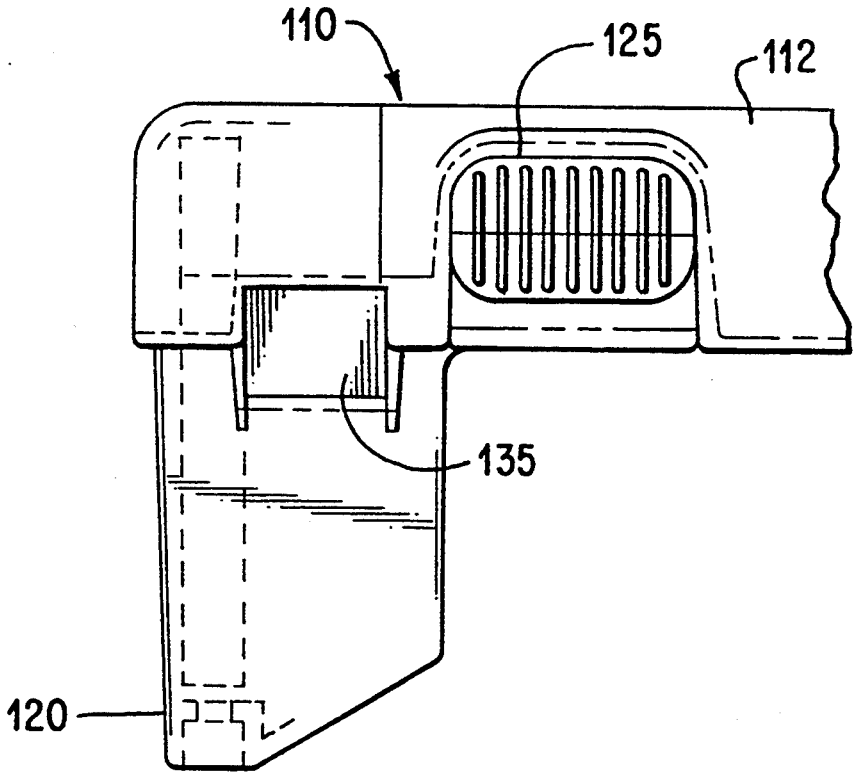
FIG. 11B is a partial top view showing the hook, the release button and the visual indicator of the door panel.
Figure 12A:
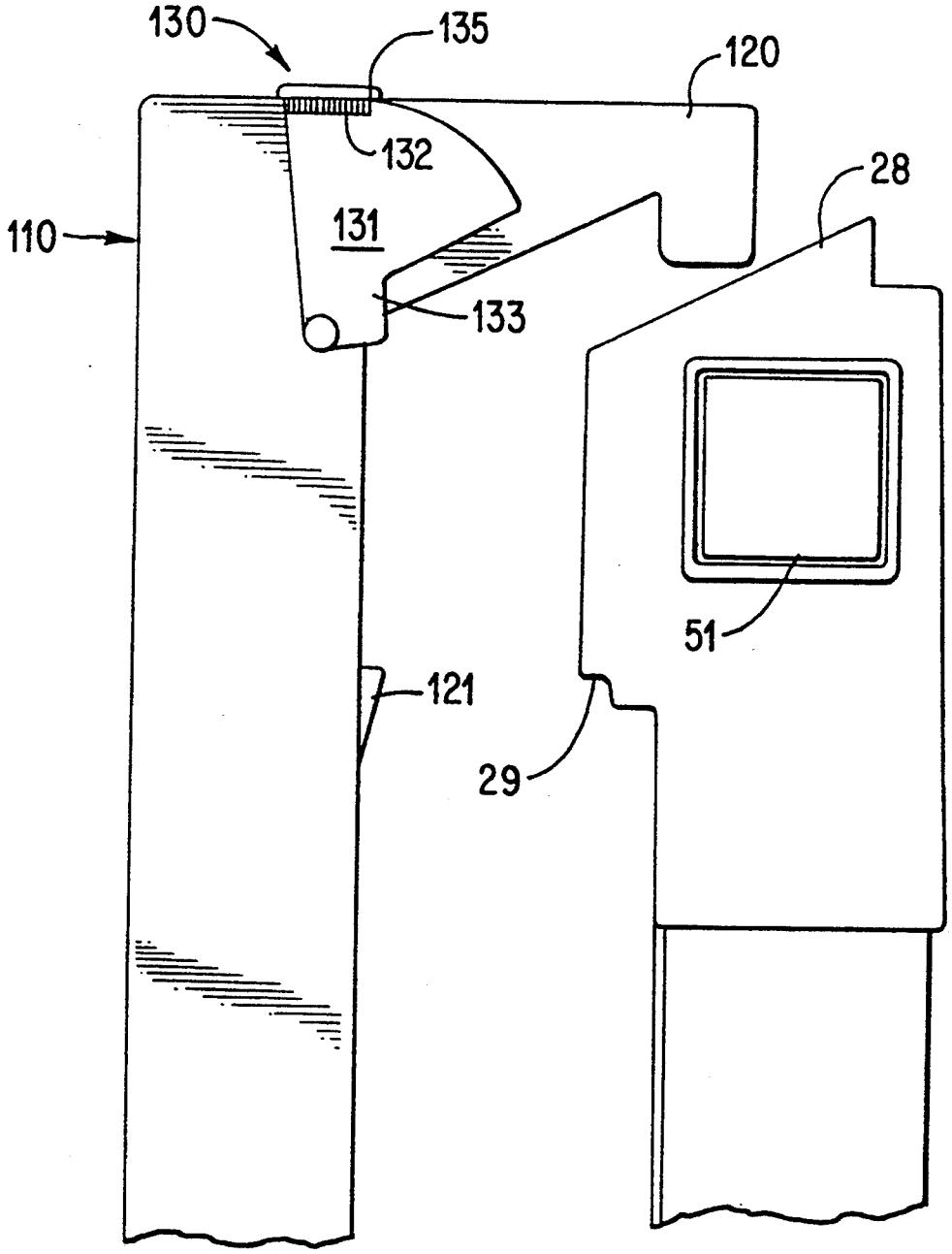
FIGS. 12A and 12B are partial end schematic views of the gate showing the door including the door latch and indicator mechanisms, and showing the top rail of the gate frame.

A visual indicator 130 on the door 110 indicates whether the door 110 is positively closed and latched. The visual indicator 130 visually alerts the user when the door is not securely closed and latched by showing a red area. The indicator 130 includes a pivoting indicator member 131 with a red color break area 132 stamped thereon. As shown in FIGS. 11B and 12A, the pivoting indicator member 131 is biased to display the red color break area 132 through a window 135 in the door 110 when the door 110 is open or only partially closed.

Figure 12B:
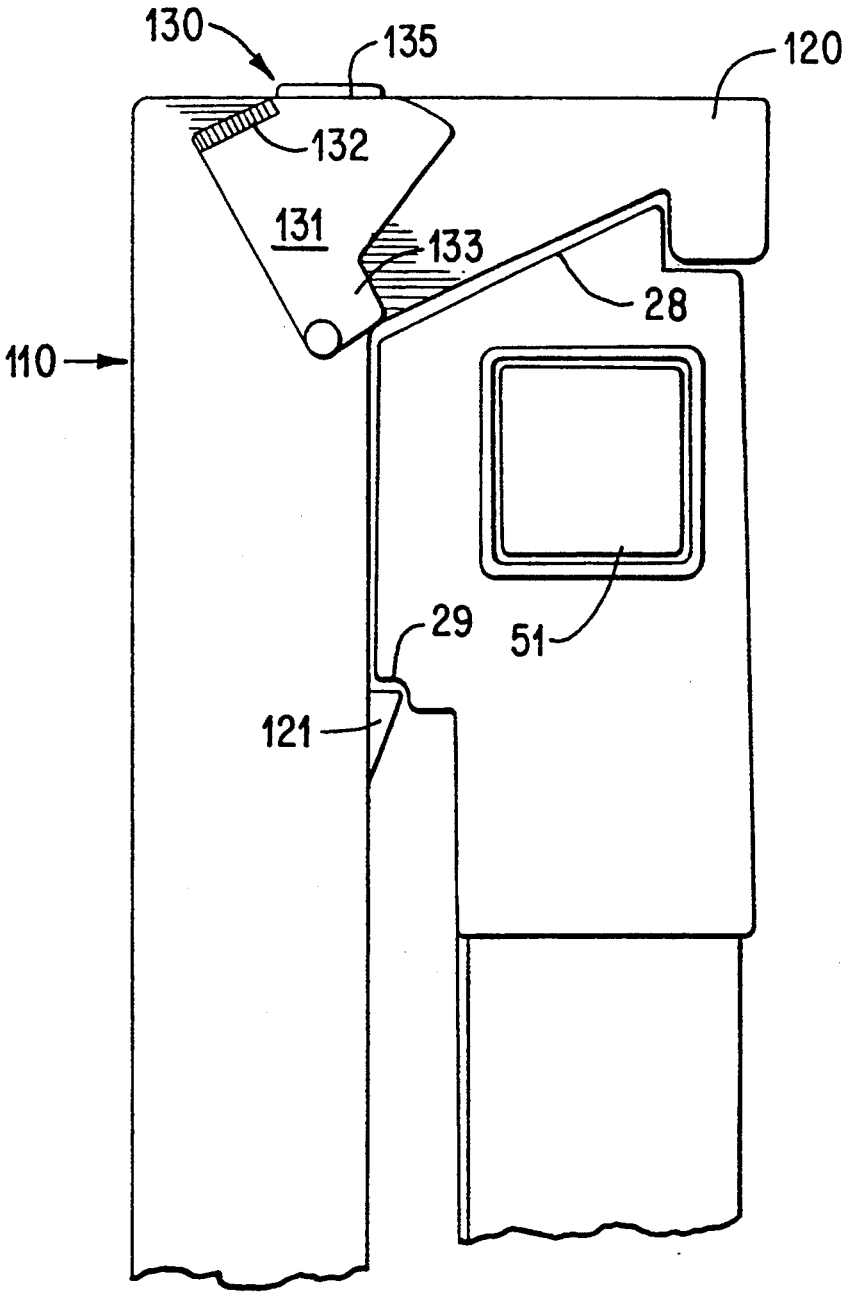

When the door 110 is fully closed and latched, a rib 133 which extends from the indicator member 131 and protrudes out of the back side of the door 110 is pushed in flush with door 110 by contact with the top rail 28, as shown in FIG. 12B. This causes the indicator member 131 to pivot sufficiently to cause the red area 132 to be hidden out of view of the area of window 135 so that the red area 132 is not visible.

Although in the foregoing embodiment, the force-distribution bar 70 is described as being used on only one side of the gate, it can be used on both sides of the gate, if desired. For example, an alternative embodiment includes a second force-distribution bar mounted to the first gate frame member instead of bumpers 31 and 32.

Figure 14:
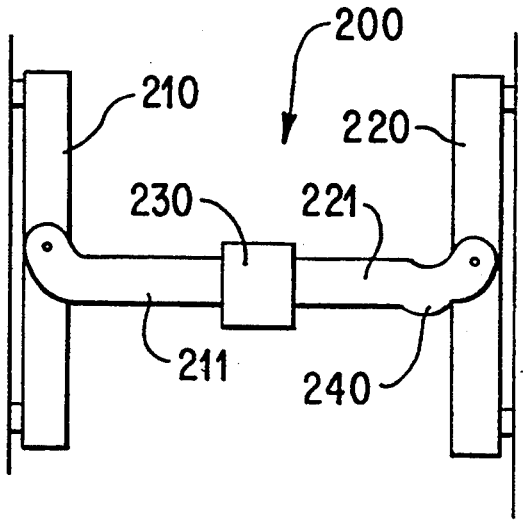
FIG. 14 is a schematic view showing an alternative embodiment of the invention.

Another alternative embodiment of the invention 200 shown in FIG. 14 includes two force-distribution members 210 and 220. A first connecting portion 211 is connected directly to the pivot point 212 of a first force-distribution bar 210. A latch 230 similar to the latch described above displaces a second connecting portion 221 that is connected by a resilient portion 240 to the pivot point 222 of a second force distribution member 220.

A force-distribution bar also could be mounted by a pivot to one or both sides of the known conventional pressure-fit gates. By way of example, a force-distribution bar could be mounted by a pivot to one or both sides of a gate such as that described in U.S. Pat. No. 4,607,455 to Bluem et al in order to compensate for an out-of-square or variable-width doorway opening and to distribute the outward pressure force in a predetermined proportion between upper and lower locations.

Figure 15:
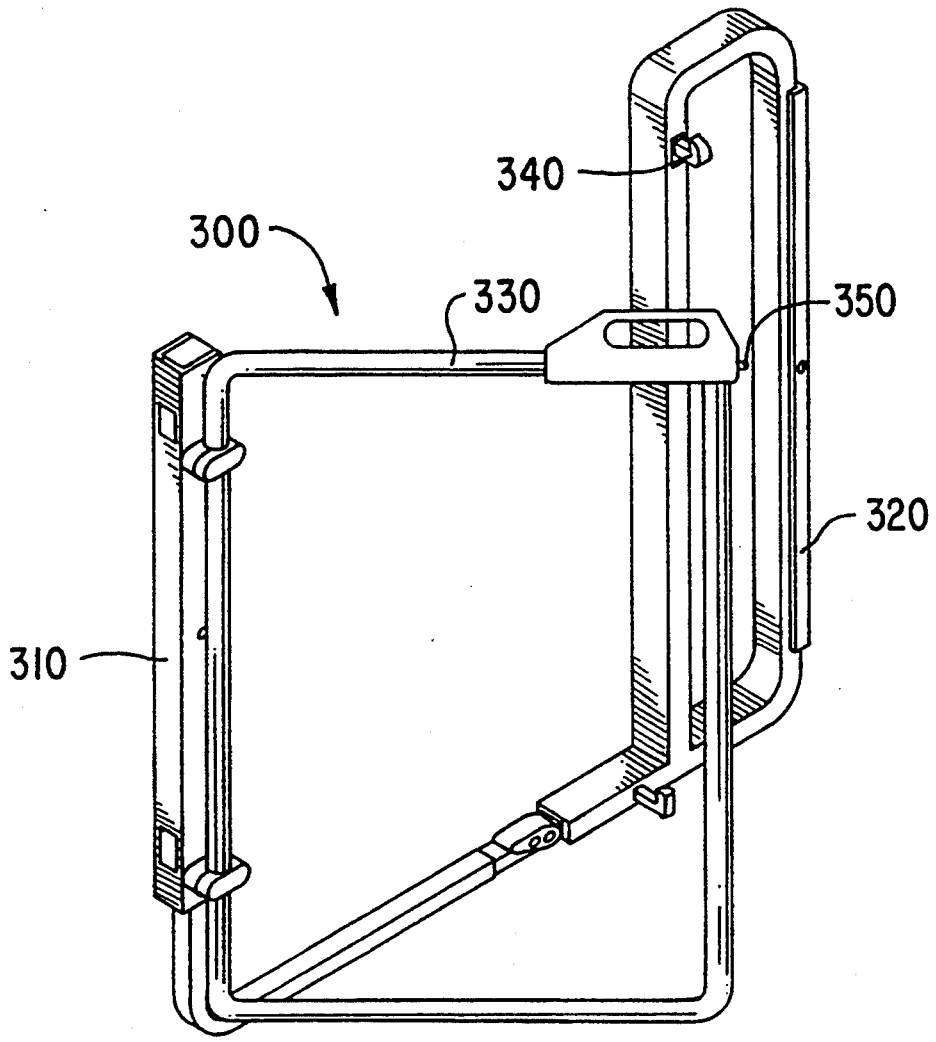
FIG. 15 is a schematic perspective view showing another alternative embodiment of the invention.

FIG. 15 shows another alternative embodiment of the invention 300 including two force-distribution members 3 10 and 320, which may have a U-shaped cross section as shown. This embodiment also illustrates that the door 330 may be held closed by engagement of a hook 340, or other suitable engagement member mounted to the gate, with a rod 350, or other suitable engagement member mounted to the door 330.

Operation

The method of operating the gate will be more fully described below. Initially, the overall gate width is adjusted by sliding the catch member sideways using the thumb depression and simultaneously lifting the lock lever to put the latch in the non-engaged position. With the lock lever fully lifted, the gate is inserted in the doorway opening and the gate frame members are moved relative to each other so that the contact pads are approximately in contact with the doorway opening sides.

Next, the lock lever is fully depressed (it is positioned so that it may be conveniently depressed by stepping on it). This causes the latch to outwardly displace the lateral connecting portions relating to each other, which causes deflection of the intermediate portions, or corners, of the tubes and urges the vertical side portions of the gate outwardly against the sides of the doorway opening, thereby applying pressure to firmly retain the gate in the opening. This operation can be performed with the gate door opened or closed.

To open the gate door, the operator pushes the button to retract the interlocking tab and then lifts the door handle while continuing to depress the button. The door is then lifted up far enough so that the hook clears the top rail of the gate, at which point the door may be swung open.

To close the gate door, the door is swung closed and is lifted so that the hook clears the top rail. Then the door is lowered until the hook hooks over the top rail. Pushing down on the door will fully seat the hook on the top rail and allow the retractable interlocking tab to clear the shoulder and protrude from the door to interlock with the shoulder. The door is now securely held closed.

To remove the gate from the doorway opening, the operator slides the catch member sideways as described above and lifts the lock lever of the latch to release the latch. This will release the pressure on the doorway opening so that the gate can be removed. The overall gate width can then be adjusted, if necessary, for the next time the gate is used.

What is claimed is:

1. A gate for insertion across a lateral opening defined by two opening side surfaces, said gate comprising:

a first frame member having a first upright portion attached to a lateral first connecting portion, said first upright portion including a first side contact portion;

a second frame member having a second upright portion attached to a lateral second connecting portion, said second upright portion including a second side contact portion, and said lateral first and second connecting portions being slidably connected for displacement relative to each other along the lateral direction so that said first and second frame members together form a generally U-shaped gate frame having an adjustable width; and a latch mounted to said first connecting portion and releasably engageable with said second connecting portion, wherein said latch is releasable to permit free sliding displacement of said connecting portions for adjustment of the gate width to fit within the opening so that said first and second side contact members are approximately in contact with the side surfaces, wherein said latch is operable to engage said second connecting portion and to displace said second connecting portion relative to said first connecting portion by a pre-selected displacement outwardly in the lateral direction, the outward displacement being imparted to flex said first and second upright portions so that said first and second side portions each apply an outward lateral force via said contact portions to the respective opening side surfaces to frictionally retain said gate in the opening, and wherein said latch comprises:

a bracket slidable longitudinally along the second connecting portion;

a moving mechanism connected to said first connecting portion and connected to said bracket for moving said bracket away from said first connecting portion in the lateral direction; and a frictional inter-engagement member for frictionally inter-engaging said bracket and said second connecting portion and for preventing said bracket from sliding longitudinally along said second connecting portion when said bracket is moved away from said first connecting portion by said moving mechanism, so that movement of said bracket away from said first connecting portion by said moving mechanism causes displacement of said second connecting portion.

2. A gate according to claim 1, wherein said connecting portions are connected in a telescoping relationship.

3. A gate according to claim 1, wherein said first upright portion includes a first side portion attached to said first connecting portion by a curved first intermediate portion and said second upright portion includes a second side portion attached to said second connecting portion by a curved intermediate portion.

4. A gate according to claim 1, wherein said moving mechanism moves said bracket by a pre-selected distance.

5. A gate according to claim 4, wherein said latch further comprises a slidable plate disposed between said rod and said second connecting portion.

6. A gate according to claim 1, wherein said bracket comprises two parallel bracket side portions, each having a slot extending therethrough, and a bracket connecting portion connecting said bracket side portions, wherein said frictional inter-engagement member comprises a rod spanning between said bracket side portions and located on the opposite side of said second connecting member from said bracket connecting portion, said rod having two ends, each end of said rod passing through and slidable along one said slot, and wherein said slots are angled upwardly away from said first connecting portion so that, when said bracket is moved away from said first connecting portion by said moving mechanism, said slots apply a normal force to urge said rod against said second connecting portion so that said rod frictionally inter-engages said second connecting portion and said bracket, and so that movement of said bracket away from said first connecting position causes displacement of said second connecting portion away from said first connecting portion.

7. A gate according to claim 1, wherein said moving mechanism comprises:

a lever having a first end pivotally attached to said bracket and a second end; and a link member having a first end pivotally attached to a medical portion of said lever, and a second end pivotally attached to said first connecting portion, whereby pivotal movement of said second end of said lever towards said first connecting portion moves said bracket away from said first connecting portion by the pre-selected distance in the lateral direction.

8. A gate according to claim 1, further comprising a panel spanning at least partially between said first and second frame members to at least partially block the opening.

9. A gate according to claim 8, wherein said panel includes a hinged door.

10. A gate according to claim 9, further comprising a door latch mechanism for latching said door in a closed position.

11. A gate according to claim 10, wherein one of said frame members comprises a rail, said door comprises an engaging member for engaging said rail, and said door latch mechanism comprises an interlocking member for causing said door to interlock with said rail to lock said door in the closed position.

12. A gate according to claim 11, further comprising an indicator for indicating when said door is in a closed position.

13. A gate according to claim 1, wherein said first side contact portion comprises a force distribution member pivotally attached to said first upright portion at a pivot location on said force distribution member, said force distribution member having two contact locations located on opposite sides of the pivot location from each other, and said force distribution member receiving the outward lateral force from said first upright side portion at the pivot location and distributing the outward lateral force for application against one opening side surface at said two contact locations.

14. A gate according to claim 1, wherein said second side contact portion comprises a force distribution member pivotally attached to said second upright portion at a pivot location on said force distribution member, said force distribution member having two contact locations located on opposite sides of the pivot location from each other, and said force distribution member receiving the outward lateral force from said second upright portion at the pivot location and distributing the outward lateral force for application against one opening side surface at said two contact locations.

15. A gate for insertion across a lateral opening defined by two opening side surfaces, said gate comprising:

a first frame member having a first upright portion attached to a lateral first connecting portion, said first upright portion including a first side contact portion;

a second frame member having a second upright portion attached to a lateral second connecting portion, said second upright portion including a second side contact portion, and said lateral first and second connecting portions being slidably connected for displacement relative to each other along the lateral direction so that said first and second frame members together form a generally U-shaped gate frame having an adjustable width;

a latch mounted to said first connecting portion and releasably engageable with said second connecting portion;

a panel spanning at least partially between said first and second frame members to at least partially block the opening, said panel including a hinged door; and a door latch mechanism for latching said door in a closed position;

wherein said latch is releasable to permit free sliding displacement of said connecting portions for adjustment of the gate width to fit within the opening so that said first and second side contact members are approximately in contact with the side surfaces, and wherein said latch is operable to engage said second connecting portion and to displace said second connecting portion relative to said first connecting portion by a pre-selected displacement outwardly in the lateral direction, the outward displacement being imparted to flex said first and second upright portions so that said first and second side portions each apply an outward lateral force via said contact portions to the respective opening side surfaces to frictionally retain said gate in the opening, wherein one of said frame members comprises a rail, said door comprises an engaging member for engaging said rail, and said door latch mechanism comprises an interlocking member for causing said door to interlock with said rail to lock said door in the closed position, and wherein said rail has a shoulder, and said interlocking member comprises a retractable tab, said tab being biased to an extended position for engaging said shoulder to interlock said rail with said door, and said tab being selectively retractable to unlock said door.

16. A gate for insertion across a lateral opening defined by two opening side surfaces, said gate comprising:

a first frame member having a first upright portion attached to a lateral first connecting portion, said first upright portion including a first side contact portion;

a second frame member having a second upright portion attached to a lateral second connecting portion, said second upright portion including a second side contact portion, and said lateral first and second connecting portions being slidably connected for displacement relative to each other along the lateral direction so that said first and second frame members together form a generally U-shaped gate frame having an adjustable width;

a latch mounted to said first connecting portion and releasably engageable with said second connecting portion;

a panel spanning at least partially between said first and second frame members to at least partially block the opening, said panel including a hinged door;

a door latch mechanism for latching said door in a closed position; and an indicator for indicating when said door is in a closed position;

wherein said latch is releasable to permit free sliding displacement of said connecting portions for adjustment of the gate width to fit within the opening so that said first and second side contact members are approximately in contact with the side surfaces, and wherein said latch is operable to engage said second connecting portion and to displace said second connecting portion relative to said first connecting portion by a pre-selected displacement outwardly in the lateral direction, the outward displacement being imparted to flex said first and second upright portions so that said first and second side portions each apply an outward lateral force via said contact portions to the respective opening side surfaces to frictionally retain said gate in the opening, wherein one of said frame members comprises a longitudinal rail, said door comprises an engaging member for engaging said rail, and said door latch mechanism comprises an interlocking member for causing said door to interlock with said rail to lock said door in the closed position, and wherein said indicator comprises:

a pivoting indicator member pivotally mounted to said door and contactable with said rail, said indicator member pivotable between a first position and a second position, and indicating that said door is closed when said indicator member is in the second position; and a biasing mechanism for biasing said indicator member towards the first position, wherein said indicator member is moved to the second position by contact with said rail when said door is closed.

17. A gate for insertion across a lateral opening defined by two opening side surfaces, said gate comprising:

a first gate member;

a second gate member connected to said first gate member;

a first engaging member located on said second gate member;

a door hingedly mounted to said first gate member, said door comprising a second engaging member for engaging said first engaging member and a door latch mechanism; and an interlocking member for causing said door to interlock with said first engaging member to lock said door in a closed position, wherein said first engaging member comprises a longitudinal rail, said second engaging member being engageable with said rail at a plurality of positions along said rail and being slidable along said rail while engaged.

18. A gate according to claim 17, wherein said first and second gate members are connected for displacement relative to each other along the lateral direction.

19. A gate according to claim 17, further comprising an indicator for indicating when said door is in a closed position.

20. A gate according to claim 17, wherein said second gate member further comprises a first engageable portion located separately from said first engaging member and said door comprises an elongated second engageable portion located separately from said second engaging member, wherein said first engageable portion engages said second engageable portion to further lock said door in the closed portion.

21. A gate according to claim 20, wherein said first gate member comprises a threshold portion and said first engageable portion comprises a groove defined on said threshold portion, and wherein said door comprises a base end and said second engageable portion comprises a flange protruding from said base end.

22. A gate according to claim 17, wherein said rail has a shoulder, and said interlocking member comprises a retractable tab, said tab being biased to an extended position for engaging said shoulder to interlock said rail with said door, and said tab being selectively retractable to unlock said door.

23. A gate for insertion across a lateral opening defined by two opening side surfaces, said gate comprising:

a first gate member;

a second gate member connected to said first gate member;

a first engaging member located on said second gate member;

a door hingedly mounted to said first gate member, said door comprising a second engaging member for engaging said first engaging member; and an interlocking member for causing said door to interlock with said first engaging member to lock said door in a closed position, wherein said first engaging member has a shoulder, and said interlocking member comprises a retractable tab, said tab being biased to an extended position for engaging said shoulder to interlock said door with said first engaging member, and said tab being selectively retractable to unlock the door.

24. A gate for insertion across a lateral opening defined by two opening side surfaces, said gate comprising:

a first gate member;

a second gate member connected to said first gate member;

a first engaging member located on said second gate member;

a door hingedly mounted to said first gate member, said door comprising a second engaging member for engaging said first engaging member and a door latch mechanism;

an interlocking member for causing said door to interlock with said first engaging member to lock said door in a closed position; and an indicator for indicating when said door is in a closed position, wherein said indicator comprises:

a pivoting indicator member pivotally mounted to said door and contactable with said first engaging member, said indicator member pivotable between a first position and a second position, and indicating that said door is closed when said indicator member is in the second position; and a biasing mechanism for biasing said indicator member towards the first position, wherein said indicator member is moved to the second position by contact with said first engaging member when said door is closed.

25. A gate for insertion across a lateral opening defined by two opening side surfaces, said gate comprising:

a first gate member;

a second gate member connected to said first gate member;

a first engaging member located on said second gate member;

a door hingedly mounted to said first gate member, said door comprising a second engaging member for engaging said first engaging member and a door latch mechanism;

an interlocking member for causing said door to interlock with said first engaging member to lock said door in a closed position;

a first hinge comprising a tapered first pin mounted to said door and a first bracket mounted to said first side member for receiving said first pin; and a second hinge comprising a second pin mounted to said door and a second bracket mounted to said first side member and having an elongated slot for receiving said second pin, wherein said hinges permit rotation of said door about a hinge axis and permit rotation of said door about an axis at said first hinge perpendicular to the hinge axis.

26. A gate for insertion across a lateral opening, said gate comprising:

a gate element;

a door closable to a closed position where said door abuts said gate element; and an indicator for indicating when said door is closed and abutting said gate element, wherein said indicator comprises:

a pivoting indicator member pivotally mounted to said door and contactable with said gate element, said indicator member pivotable between a first position and a second position, and indicating that said door is closed when said indicator member is in the second position; and a biasing mechanism for biasing said indicator member towards the first position, wherein said indicator member is moved to the second position by contact with said gate element when said door is closed.

27. A gate according to claim 26, wherein said door further comprises a window and said pivoting indicator member includes a marked area, and wherein said marked area is visible through said window when said indicator is in one of the first and second positions.

28. A gate for insertion across a lateral opening, said gate comprising:

a gate element;

a door closable to a closed position where said door abuts said gate element; and an indicator for indicating when said door is closed and abutting said gate element, wherein said indicator comprises:

a pivoting indicator member pivotally mounted to said gate element and contactable with said door, said indicator member pivotable between a first position and a second position, and indicating that said door is closed when said indicator member is in the second position; and a biasing mechanism for biasing said indicator member towards the first position, wherein said indicator member is moved to the second position by contact with said door when said door is closed.

* * * * *